United States Patent [19]

Spencer et al.

[11] Patent Number: 4,986,961

[45] Date of Patent: Jan. 22, 1991

[54] FINE GRAIN TUNGSTEN HEAVY ALLOYS CONTAINING ADDITIVES

[75] Inventors: James R. Spencer, Sayre; James A. Mullendore, Towanda, both of Pa.

[73] Assignee: GTE Products Corporation, Stamford, Conn.

[21] Appl. No.: 415,687

[22] Filed: Oct. 2, 1989

Related U.S. Application Data

[63] Continuation of Ser. No. 140,373, Jan. 4, 1988, Pat. No. 4,885,031.

[51] Int. Cl.[5] ..... B22F 1/00

[52] U.S. Cl. ..... 419/36; 419/38; 419/47; 419/57

[58] Field of Search ..... 75/248; 419/47, 57, 419/36, 38

[56] References Cited

U.S. PATENT DOCUMENTS

| | | | |
|---|---|---|---|
| 4,012,230 | 3/1977 | Dickinson et al. | 75/212 |
| 4,612,162 | 9/1986 | Morgen et al. | 419/28 |
| 4,784,690 | 11/1988 | Mullendore | 75/248 |
| 4,851,042 | 7/1989 | Bose et al. | 75/248 |
| 4,885,031 | 12/1989 | Spencer et al. | 75/248 |
| 4,938,799 | 7/1990 | Nicolas | 75/248 |

*Primary Examiner*—Stephen J. Lechert, Jr.
*Assistant Examiner*—N. Bhat
*Attorney, Agent, or Firm*—Robert E. Walter

[57] ABSTRACT

A consolidated tungsten heavy alloy body consisting essentially of from about 88% to about 98% by weight of tungsten, from about 0.25% to about 1.5% by weight of a grain size reducing additive selected from the group consisting of ruthenium, rhenium and mixtures thereof, balance iron and nickel in a weight ratio of nickel to iron of from about 1:1 to about 9:1 wherein the consolidated body has greater than about 2500 grains per square millimeter as determined from the microstructure of the body. A process for producing the consolidated body comprises forming a relative uniform blend of the described metal powders, compacting the powders to form a green body then solid state sintering to remove binders followed by liquid phase sintering the green body to full density.

3 Claims, No Drawings

FINE GRAIN TUNGSTEN HEAVY ALLOYS CONTAINING ADDITIVES

This is a continuation of copending application Ser. No. 07/140,373, filed Jan. 4, 1988, now U.S. Pat. No. 4,885,031.

The work resulting in this invention was carried out under Contract No. DAAL04-86-C-0023 and the United States Government has certain rights in the invention in accordance with the Patent Rights clause contained in that contract.

FIELD OF THE INVENTION

This invention relates to tungsten heavy alloys. More particularly it relates to tungsten heavy alloys containing additives which enable a fine grain tungsten heavy alloy to be achieved.

BACKGROUND OF THE INVENTION

Tungsten heavy alloys generally contain from about 88% to about 98% by weight of tungsten, balance iron and nickel. For some applications cobalt and copper have been used as alloying additions.

Tungsten and its alloys have been used for armor penetrates. Finer grain tungsten is believed to improve the performance of such penetrates. Conventional liquid phase sintered tungsten heavy alloys have a grain size of from about 25 microns to about 100 microns. Thus, the number of grains per $mm^2$ is from about 100 to about 2000. The starting size of the tungsten powder has little effect upon the grain size of the sintered material.

It is believed, therefore, that a tungsten heavy alloy material having the beneficial properties of tungsten heavy alloy but with a smaller grain size would be an advancement in the art.

SUMMARY OF THE INVENTION

In accordance with one aspect of this invention there is provided a consolidated tungsten heavy alloy body consisting essentially of from about 88% to about 98% by weight of tungsten, from about 0.25% to about 1.5% by weight of a grain size reducing additive selected from the group consisting of ruthenium, rhenium and mixtures thereof, balance nickel and iron in a weight ratio of nickel to iron of from about 1:1 to about 9:1 wherein the consolidated body has greater than about 2500 grains per square millimeter as determined from the microstructure of the body.

In accordance with another aspect of this invention, there is provided a process for producing consolidated bodies having the lower grain sizes which comprises:

(a) forming a relatively uniform blend of elemental metal powders, wherein the blend consists essentially of from about 88% to about 98% by weight of tungsten, from about 0.25% to about 1.5% by weight of a grain size reducing additive selected from the group consisting of ruthenium, rhenium and mixtures thereof, balance nickel and iron in a weight of about 1:1 to about 9:1, (b) pressing the powder to form a green body and.

(c) sintering the green body in a reducing atmosphere for a time sufficient to achieve near theoretical density.

DETAILED DESCRIPTION OF THE PREFERRED EMBODIMENTS

For a better understanding of the present invention, together with other and further objects, advantages, and capabilities thereof, reference is made to the following disclosure and appended claims in connection with the above described drawings and description of some of the aspects of the invention.

The grain size reducing additive should be added in amounts of from about 0.25% to about 1.5% by weight. More than about 1.5% by weight will result in an adverse effect upon the structural properties of the alloy e.g. hardness and strength. Less than about 0.25% by weight does not achieve the desired amount of grain size reduction. From about 0.5% to about 1.25% by weight of the grain size reducing additive is preferred. The grain size reducing additive can be selected from the group consisting of ruthenium, rhenium and mixtures thereof. Ruthenium tends to yield more size reduction at a given level than rhenium. The FIGURE shows the dramatic effect of the grain size reducing additives. More particularly, the FIGURE shows that at about 2 atomic percent of ruthenium the consolidated material has about 5000 grains per $mm^2$ as compared to about 1600 grains per $mm^2$ in a similar material without the additive. Rhenium at the 1 atomic percent level yields a material which has about 3500–3600 grains per $mm^2$. It is to be noted that a material having about 2400 grains per $mm^2$ has an average grain size of about 20 microns and that a material having about 5500 grains per $mm^2$has an average grain size of about 13.5 microns.

The tungsten can vary from about 88% to about 98% by weight of the alloy. Iron and nickel constitute the balance of the alloy containing the aforementioned grain size reducing additives. The nickel to iron ratio can vary from about 1:1 to about 9:1 with from about 7:3 to about 8:2 being preferred.

In the practice of the process of this invention a relatively uniform blend of the elemental metal powders is preferably prepared. While the elemental metal powders are preferred as the initial starting material, metallic salts having a fugitive non-metallic component can be used as long as the proper amount of metallic elements are present in the blend. After the relative uniform blend is made by using conventional blending equipment such as a V blender, the material is heated to remove the volatile components if any are present. Time and temperatures will depend upon the materials that are used and will be known to those skilled in the art of powder metallurgy.

After the uniform blend of elemental metal powders is formed the powders are pressed into a green body having sufficient strength to prevent breakage during the normal handling required in moving the bodies from the presses used to form the green bodies to other locations such as the sintering furnaces. A typical consolidation technique for producing green bodies is isostatic pressing using pressures of from about 30 psi to about 50 psi.

While not essential, the green body is preferably solid state sintered at a temperature which is below the melting point of any of the elements for a period of time sufficient to remove any binders used to aid in the pressing to form a green body and to achieve a density greater than about 80% of the theoretical density. Since nickel is the lowest melting element utilized in the practice of this invention and it melts at about 1455° C., the initial temperature will be below about 1425° C. and preferably about 1400° C. The time required for presintering at about 1400° C. is about 4 hours. Longer times are required for lower temperatures while shorter times are required at temperatures approaching the melting point of nickel. After the solid state sintering step, the material is then sintered to full density by liquid phase sintering above the melting point of the nickel. The liquid phase sintering temperature will depend upon the tungsten content. About 1530° C. for about 45 minutes is sufficient to achieve full density for alloys containing about 93% by weight of tungsten and a 7:3 nickel to iron ratio. For alloys containing about 95% by weight of tungsten and a 7:3 nickel to iron ratio about 1550° C. is required. Sintering is carried out in a reducing atmosphere which includes hydrogen, hydrogen-nitrogen mixtures and disassociated ammonia. While the aforementioned times and temperatures can be varied, one skilled in the art of powder metallurgy will recognize that appreciably higher temperatures merely add to the cost of the process while lower temperature do not achieve the desired degree of liquid phase sintering because the melting point of nickel may not be reached.

To aid in the understanding of this invention the following detailed example is presented. All parts percentages and proportions are by weight unless otherwise indicated.

EXAMPLE

Alloys shown in the Table below are prepared by blending elemental metal powders of the metals shown for one hour in a V-blender. Bars are made from the powder blends by isostatically pressing the blends at about 35 ksi. The bars are sintered in wet hydrogen for about 4 hours at about 1400° C. followed by sintering at 1530° C. for 45 minutes. The microstructure of the sintered bars are evaluated and the FIGURE plots grain size against the atomic percent of the ruthenium and rhenium. It is to be noted that for the alloys of the Example that for rhenium the atomic and weight percentages are about the same whereas with ruthenium the atomic percentage is about double that of the weight percentage.

| Alloy Blends (weight percent) | | | | |
|---|---|---|---|---|
| Tungsten | Nickel | Iron | Ruthenium | Rhenium |
| 93 | 4.9 | 2.1 | — | — |
| 93 | 4.5 | 2.0 | 0.5 | — |
| 93 | 4.2 | 1.8 | 1.0 | — |
| 93 | 4.5 | 2.0 | — | 0.5 |
| 93 | 4.2 | 1.8 | — | 1.0 |

While there has been shown and described what are considered the preferred embodiments of the invention, it will be obvious to those skilled in the art that various changes and modifications may be made therein without departing from the scope of the invention as defined by the appended claims.

What is claimed is:

1. A process for producing consolidated bodies of tungsten heavy metal having the lower grain sizes comprising (a) forming a relatively uniform blend of elemental metal powders, wherein the blend consists essentially of from about 88% to about 98% by weight of tungsten, from about 0.25% to about 1.5% by weight of a grain size reducing additive selected from the group consisting of ruthenium, rhenium and mixtures thereof, balance iron and nickel in a weight ratio of nickel to iron of from about 1:1 to about 9:1, (b) pressing the powder to form a green body, (c) sintering the green body in a reducing atmosphere for a time sufficient to achieve near theoretical density and (d) liquid phase sintering for a time sufficient to achieve near theoretical density.

2. A process according to claim 5 wherein said green body is sintered at a temperature of from about 1530° C. to about 1550°.

3. A process according to claim 5 wherein prior to liquid phase sintering the body is solid state sintered to remove binders and to achieve a density of greater than about 80% of theoretical.

* * * * *